US005842411A

United States Patent [19]

Johnson

[11] Patent Number: 5,842,411

[45] Date of Patent: Dec. 1, 1998

[54] SHIELDED PRINTER

[75] Inventor: Gary Johnson, Dillon, S.C.

[73] Assignee: Dana Corporation, Toledo, Ohio

[21] Appl. No.: 919,234

[22] Filed: Aug. 28, 1997

[51] Int. Cl.[6] ..... B41F 17/00

[52] U.S. Cl. ..... 101/36; 101/363; 101/350.1

[58] Field of Search ..... 101/36, 35, 207, 101/208, 210, 349.1, 350.1, 363, 351.7; 347/103, 213

[56] References Cited

U.S. PATENT DOCUMENTS 978,839 12/1910 Bremer et al. ..... 101/213
2,719,484 10/1955 Wardell et al. ..... 101/363
3,745,920 7/1973 McKay ..... 101/35
4,152,980 5/1979 Siegal ..... 101/35

*Primary Examiner*—Edgar S. Burr
*Assistant Examiner*—Amanda B. Sandusky
*Attorney, Agent, or Firm*—Millen, White, Zelano & Branigan, P.C.

[57] ABSTRACT

A printer which prints information on articles such as filter cartridge assemblies, minimizes ink splattering and increases speed by shielding the lower portion of ink pickup rollers with an ink shielding plate. By utilizing the ink shielding plate, the speed at which the printer operates is doubled and cleanup of splattered ink is minimized.

7 Claims, 4 Drawing Sheets

14
12
12
12'
12'
26
30
12
16
24
12
10

SHIELDED PRINTER

FIELD OF THE INVENTION

This invention relates to a shielded printer. More particularly, this invention relates to a printer in which a splash guard is provided for an ink roller to minimize ink splattering.

BACKGROUND OF THE INVENTION

Devices such as filter canisters have information printed on their surfaces by printing machines as the devices are advanced through a production line. In the case of Filter assembly canisters, the canisters are indexed individually to a printing station where a printing head engages the surfaces of the cannisters and prints thereon as the cannisters rotate at the same speed as the printing head. The printing head receives ink from a pair of transfer rollers which are in turn inked by pickup rollers. The pickup rollers are liberally coated with ink from an ink fountain. In order to ensure that the ink transfer rollers are completely coated, the ink pickup roller has a length slightly longer than the ink transfer roller.

During operation, ink spatters over the printer and print pads, not only soiling the printer, but causing ink spots on the filters from ink slung onto the print pads. Consequently, at the end of each 8 hour shift, the printer must be cleaned. Moreover, the canisters have to be monitored for ink spots and, if found, washed down, repainted and then reprinted. In addition, the speed of the printer is limited because of its tendency to splatter ink. By limiting the speed of printing information on the filter assembly cannisters, the speed of the entire production line can be decreased. In order to maintain production speed, additional printing machines can be used, but additional printing machines require additional personnel and additional maintenance expense in addition to the initial cost of purchasing redundant printers.

SUMMARY OF THE INVENTION

In view of the aforementioned considerations, it is a feature of the present invention to improve printers of the aforedescribed type in order to reduce ink splattering and in order to increase substantially the speed at which the printers operate.

In view of this feature and other features, the present invention is directed to a printer for printing on articles advancing past the printer, wherein the printer comprises a rotatable printing head for engaging and printing on the articles. At least one ink transfer roller contacts the printing head to transfer ink thereto and at least one pickup roller deposits ink on the transfer roller. The pickup roller has a longitudinal axis parallel to that of the transfer roller and a length greater than that of the transfer roller, so as to define a portion extending below the transfer roller. A housing member extends vertically and partially around the pickup roller, the housing having a gap through which the pickup roller is exposed for engaging the transfer roller. A shield spans the gap in the housing and covers the portion of the pickup roller extending beneath the transfer roller to prevent ink on the pickup roller from splattering on the printer as the rollers rotate. By so shielding the pickup roller, the rollers of the printer can operate at a higher speed and thus print information on the articles at a higher speed.

In a more specific aspect of the invention, the shield is a separable attachment which is attached to the housing.

In still a further aspect of the invention, the articles being printed upon are canisters of filter assemblies.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
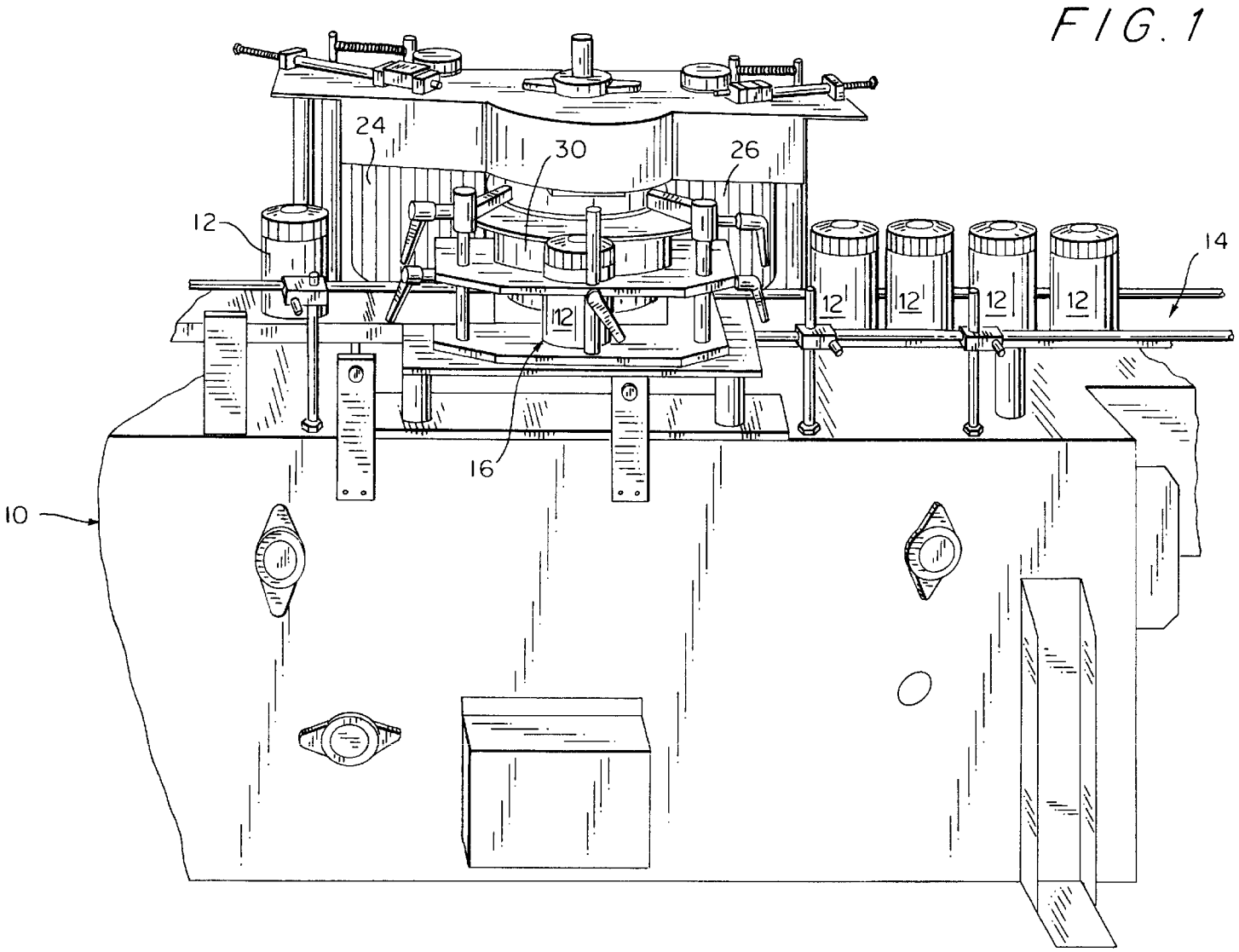
FIG. 1 is a front, perspective view of a printer employing the improvement of the present invention.

Referring now to FIG. 1, there is shown a printer 10 configured in accordance with the principles of the present invention and employing an ink shield (FIGS. 3–6) which improves the printer in accordance with the principles of the present invention. The illustrated printer 10 is known as a Kiwi printer and is available from Kiwi Coders Corporation, 265E. Messner Drive, Wheeling, Ill. 60090. The serial number of the printer 10 employed in the present invention is 96276. The printer 10 prints information on prepainted oil filter assembly canisters 12 which are conveyed through the printer by a conveyor 14. The printer 10 includes a printing station 16 that includes an indexing clamp 18 which holds individual canisters 12 in engagement with a rotating printing head 20. The printing head 20 has a print face 21 with the information thereon and prints that information on the surface of the individual cannister 12 held by the clamp 18 while the cannister rotates at the same speed as the printing head.

Figure 2:
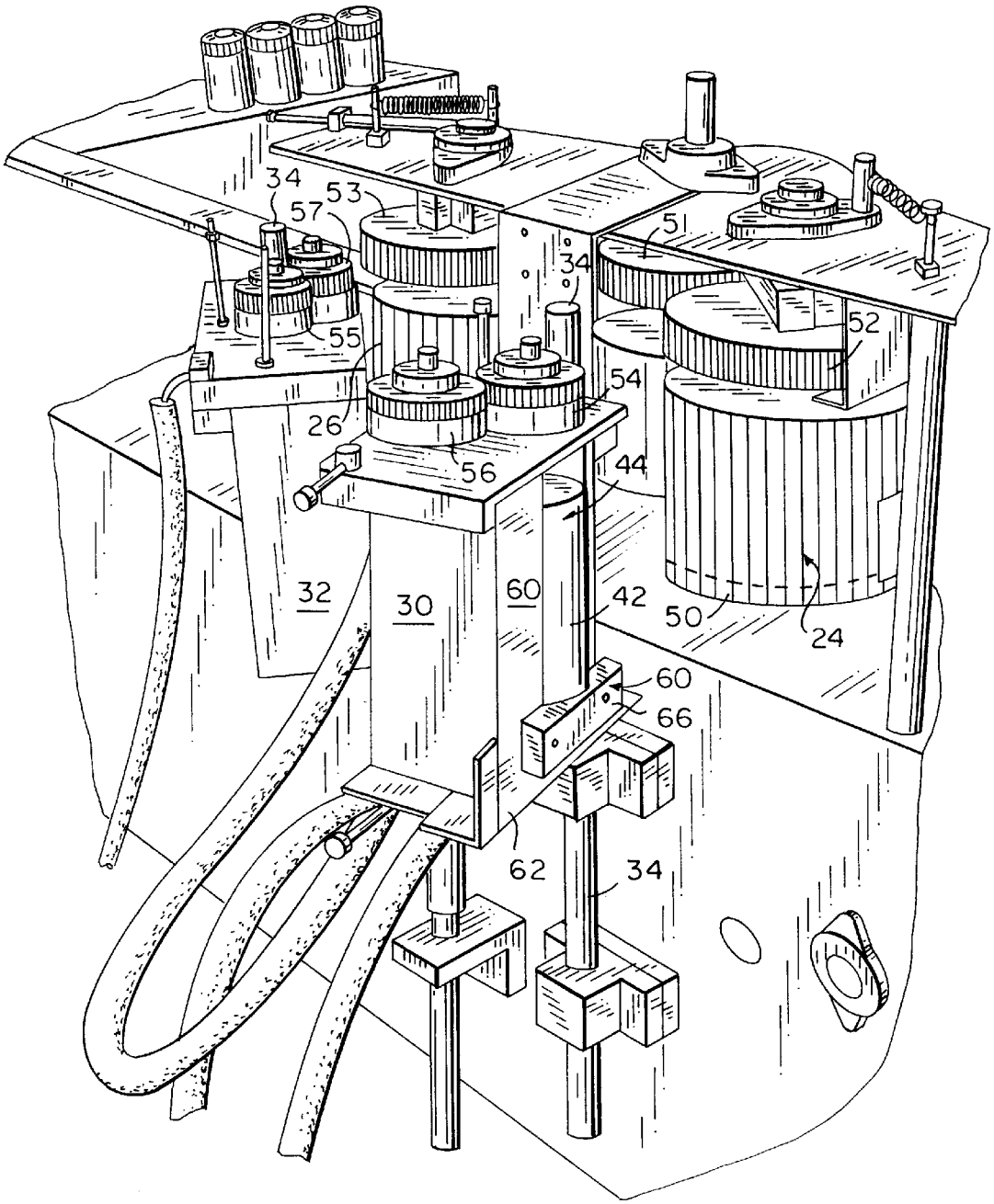
FIG. 2 is a rear view of the printer of FIG. 1.

The printing head 20 is engaged by two ink transfer rollers 24 and 26 which rotate at the same peripheral speed as the printing head and transfer ink evenly over the surface of the printing head. As is seen in FIG. 2, ink is deposited on the ink transfer rollers by two ink pickup assemblies 30 and 32, which are circumferentially spaced from the contact points between the ink transfer rollers 24 and 26 with the printing head 20. In FIG. 2, the ink pickup assemblies 30 and 32 are shown rotated out of engagement with the transfer rollers 24 and 26. During operation, the ink pickup assemblies 30 and 32 are rotated about mounting rods 34 and 36 into contact with the ink transfer rollers 24 and 26. The ink pickup assembly 32 has a structure identical to the ink pickup assembly 30 shown in FIG. 3, but is a mirror image thereof so as to transfer ink to the roller 26.

Figure 3:
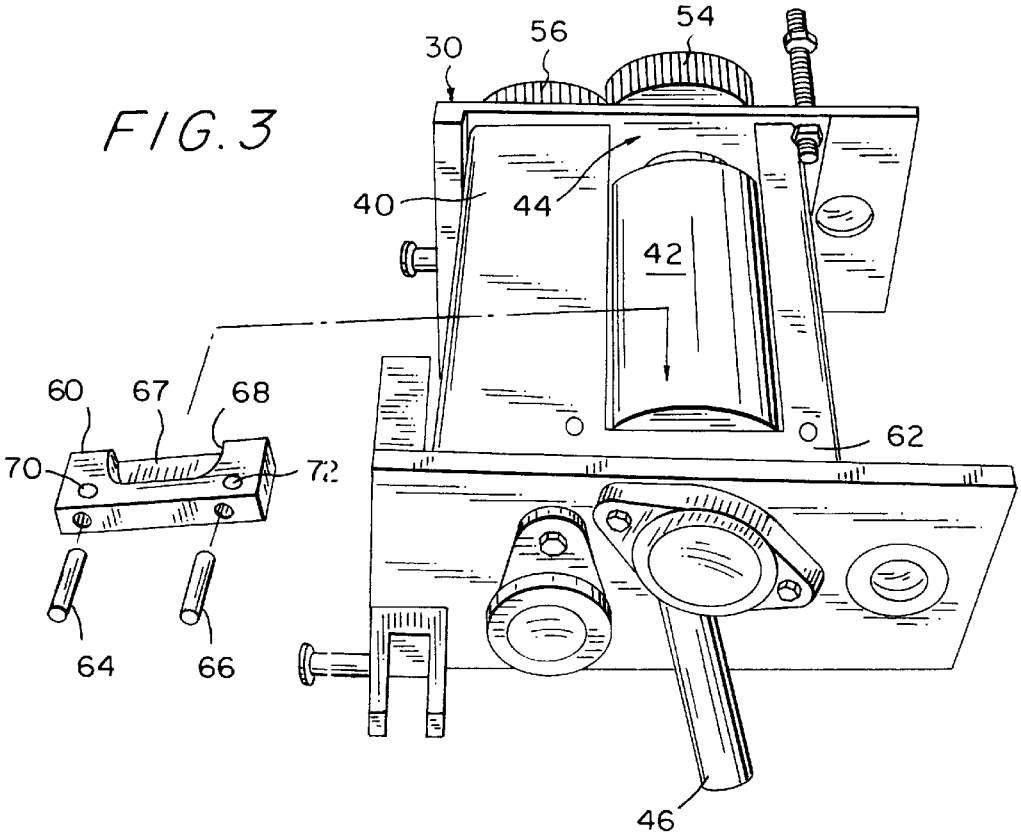
FIG. 3 is a perspective view of a pickup roller assembly and ink shield, the ink shield being the improvement of the present invention when mounted on the ink pickup roller assembly.

Referring now to FIG. 3, where one of the ink pickup assemblies, ink pickup assembly 30, is shown separately from the printer 10, it is seen that the ink pickup assembly 30 includes a housing 40 which extends about 180° around an ink pickup roller 42. The ink pickup roller 42 is aligned with a gap 44 in the housing so that the ink pickup roller can engage the ink transfer roller 26 for transferring ink to the transfer roller. The gap 44 extends in the axial direction of the roller 42 along the complete length of the pickup roller and receives ink dispensed within the housing 40 via a tube 46. The housing 40 includes another roller therein (not shown) which engages the pickup roller 42 in order to evenly distribute ink dispensed in the housing by and ink supply line 46 evenly over the surface the pickup roller 42 and to squeeze away excess ink.

The ink pickup rollers 42 in the ink pickup assemblies 30 and 32 have lengths greater than the transfer rollers 24 and 26 so that the transfer rollers are insured that ink is distributed completely over their surfaces. Using the pickup assembly 30 as an example, the pickup assembly 32 being similarly configured, a portion 50 of the pickup roller 42 extends beneath the ink transfer roller 24. Over an 8 hour working shift, ink from the roller 42 is splattered by the portion 50 into the printer 10 and onto the printing head 20. Accordingly, it is necessary to clean the printer 10 prior to the next 8 hour shift in order to keep splattered ink from soiling the filter cartridges 12 and adjacent equipment and workers, as well as the printer itself. Moreover, in order to control the phenomenon of splattering, the speed of the printer 10 must be reduced to a level substantially less than is necessary to achieve quality printing of information on the filter canisters 12.

In order for the printing roller 20, the transfer rollers 24 and 26 and the pickup rollers 42 to rotate at the same peripheral speeds, the rollers are geared to rotate together by gears 51–57 positioned at the top of each roller. The gears 54 and 57 have the same diameter as the rollers 24 and 26 so that, regardless of the roller RPM, the rollers do not slip with respect to one another. This is accomplished by a gear 51 on the printing roller 20 which meshes with gears 52 and 53 on the transfer rollers 24 and 26. Gears 52 and 53 are in turn meshed with gears 54 and 55 on the pickup rollers that in turn mesh with gears 56 and 57 that rotate distribution rollers (not shown) in the housings 40 of ink pickup assemblies 30 and 32.

In accordance with the present invention, an ink shield or splash guard 60 is fixed on the housing 40 at the lower end 62 thereof by mounting screws 64 and 66. The ink shield 60 covers the portion 50 of the pickup roller 42 which extends below ink transfer roller 26, thereby minimizing, if not substantially eliminating, ink splatter on the printer 10. Moreover, by mounting the ink shield 60 on the pickup assemblies 30 and 32, printing speed doubles from fifty-five filter canisters 12 per minute to one hundred ten filter canisters per minute.

Figure 6:
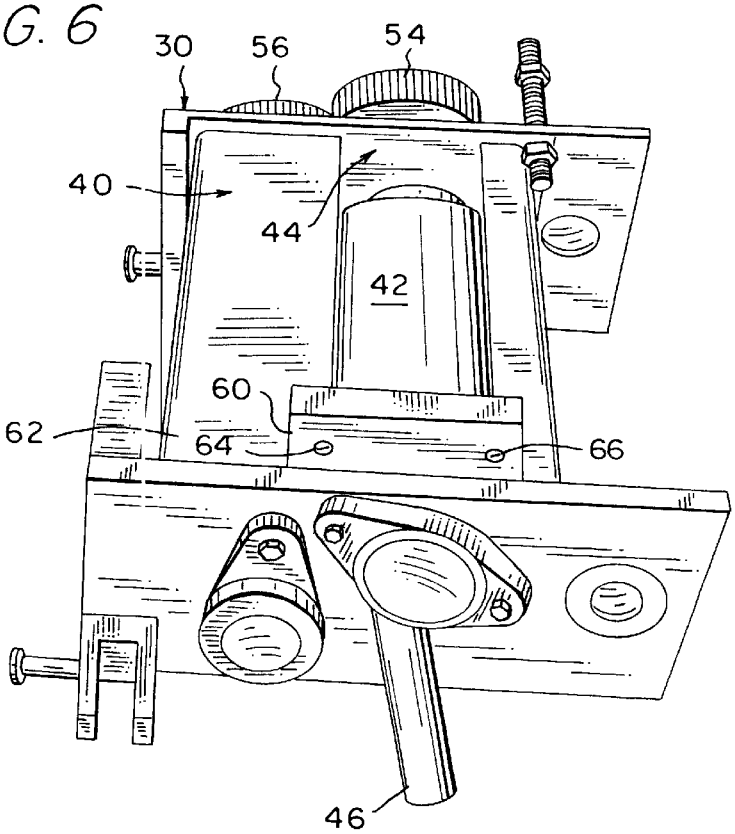
FIG. 6 is a perspective view showing the shield of FIGS. 3, 4 and 5 mounted on the pickup roller assembly of FIG. 3.
Figure 4:
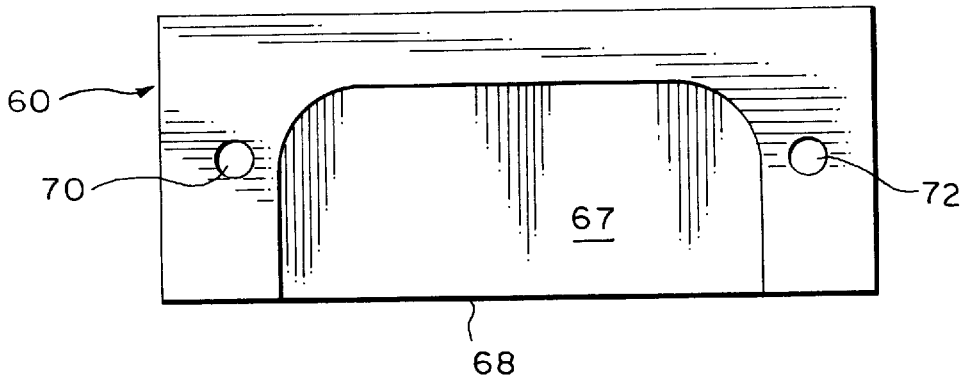
FIG. 4 is a front view of the ink shield of FIG. 3.
Figure 5:
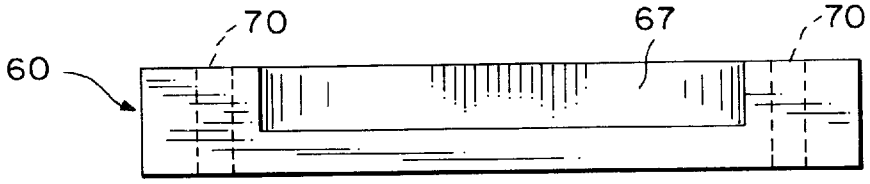
FIG. 5 is a top view of the ink shield of FIGS. 3 and 4.

Referring now to FIGS. 4 and 5 in combination with FIGS. 2, 3 and 6, it is seen that the ink shield 60 is machined from an aluminum block and is substantially rectangular in shape, having a height of about 1.5 inches and a width of about 3.75 inches. The shield is ½ inch thick and includes a recess 67 formed therein having an open side 68. First and second bores 70 and 72 are drilled through the ink shield 60 so that the bolts 64 and 66 can attach the ink shield to the lower end 62 of the housing 40. A recess 67 in the ink shield 60 accommodates the lower portion 50 of the pickup roller 42 which extends slightly, about ¼ inch in a radial direction, through the gap 44 in the housing 40 to expose the pickup roller. Again, it is emphasized that the pickup assembly 32 has a corresponding ink shield 60 to the ink shield 60 and operates in an identical manner.

To reiterate, utilization of the ink shield 60 with printer 10 results in numerous advantages and substantial cost savings because one printer can now do the work of two printers and the cleanup between working shifts is minimized because ink spatter is minimized. Thus, overall productivity of the line producing the filter assemblies 12 is substantially increased.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. In combination, a printer for printing on articles advancing past the printer wherein the printer comprises:

a rotatable printing head for engaging and printing on the articles;

at least one ink transfer roller for contacting the printing head to transfer ink thereto;

at least one pickup roller for depositing ink on the transfer roller, the pickup roller having a longitudinal axis paralleling the transfer roller and being in engagement with the transfer roller, the pickup roller having a length greater than the transfer roller and having a portion extending below the transfer roller;

a housing extending vertically and partially surrounding the pickup roller to define a gap through which the pickup roller is exposed, an ink shield member spanning the gap and covering a portion of the pickup roller extending beneath the transfer roller wherein ink on the pickup roller does not splatter on the printer as the rollers rotate, thereby allowing the rollers to rotate at a higher speed.

2. The combination of claim 1, wherein the ink shield is a separate attachment which is mounted on the housing.

3. The combination of claim 2, wherein there are two ink transfer rollers and two pickup rollers.

4. The combination of claim 1, wherein there are two ink transfer rollers and two pickup rollers.

5. The combination of claim 4, further including gears on each of the rollers which are intermeshed with gears on adjacent rollers so that each roller rotates at the same peripheral speed.

6. The printer of claim 5, wherein the articles are filter assembly canisters.

7. The combination of claim 1, wherein the articles are filter assembly canisters.

* * * * *